US006938839B2

(12) United States Patent
Xu et al.

(10) Patent No.: US 6,938,839 B2
(45) Date of Patent: Sep. 6, 2005

(54) NEEDLE ALIGNMENT FUEL INJECTOR

(75) Inventors: Min Xu, Canton, MI (US); David Lee Porter, Westland, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 300 days.

(21) Appl. No.: 10/219,353

(22) Filed: Aug. 15, 2002

(65) Prior Publication Data

US 2004/0046062 A1 Mar. 11, 2004

(51) Int. Cl.[7] ..... B05B 1/30; F02M 61/10; F02M 59/00

(52) U.S. Cl. ..... 239/533.11; 239/533.1; 239/533.2; 239/585.3; 239/585.4; 239/585.5

(58) Field of Search ..... 239/533.11, 88–92, 239/95, 533.2, 533.3, 585.1, 585.3, 585.4, 585.5, 900; 251/129.15, 129.21, 127

(56) References Cited

U.S. PATENT DOCUMENTS

| | | | | | |
|---|---|---|---|---|---|
| 5,170,945 | A | * | 12/1992 | Daly et al. | 239/585.4 |
| 5,192,048 | A | * | 3/1993 | Wakeman | 251/129.16 |
| RE35,101 | E | | 11/1995 | Kelly | |
| 5,544,816 | A | * | 8/1996 | Nally et al. | 239/585.5 |
| 5,625,946 | A | | 5/1997 | Wildeson et al. | |
| 5,642,862 | A | | 7/1997 | Wakeman et al. | |
| 6,003,790 | A | * | 12/1999 | Fly | 239/533.9 |
| 6,003,791 | A | | 12/1999 | Reiter | |
| 6,027,050 | A | | 2/2000 | Rembold et al. | |
| 6,045,116 | A | * | 4/2000 | Willke et al. | 251/129.21 |
| 6,065,692 | A | * | 5/2000 | Brinn, Jr. | 239/533.12 |
| 6,079,642 | A | | 6/2000 | Maier | |
| 6,089,473 | A | * | 7/2000 | Keim | 239/533.12 |
| 6,105,884 | A | | 8/2000 | Molnar et al. | |
| 6,173,913 | B1 | | 1/2001 | Shafer et al. | |
| 6,199,776 | B1 | | 3/2001 | Andorfer | |

FOREIGN PATENT DOCUMENTS

| | | |
|---|---|---|
| EP | 1 059 438 A3 | 5/2003 |
| JP | 2001-123910 | 5/2001 |

* cited by examiner

*Primary Examiner*—Davis Hwu
(74) *Attorney, Agent, or Firm*—Brinks Hofer Gilson & Lione

(57) ABSTRACT

A fuel injector includes a valve body and a valve seat positioned at a lower end of the valve body. A needle assembly is positioned within an inner bore of the valve body, the needle assembly including a needle body and an armature connected to an upper end of the needle body. A pair of guides are integrally formed with the valve body for guiding the needle assembly. The pair of guides includes an upper guide and a lower guide; the upper guide guiding the armature and the lower guide guiding the needle body.

22 Claims, 3 Drawing Sheets

NEEDLE ALIGNMENT FUEL INJECTOR

FIELD OF THE INVENTION

The present invention relates generally to fuel injectors, and more particularly relates to fuel injectors for internal combustion engines.

BACKGROUND OF THE INVENTION

Fuel injectors typically include a valve needle which is actuated to open and close an injector port to regulate fuel to the engine. In many injectors, the valve needle is electromagnetically actuated by a coil assembly that induces a magnetic flux in an armature connected to the valve needle. The armature is attached to one end of the valve needle, while the opposing end of the needle is shaped to seal against the valve seat for opening and closing the injector port.

Misalignment between the valve needle and the valve seat is a major cause of excessive injector leakage. To ensure acceptable alignment, an upper guide and a lower guide are typically employed to maintain the needle-armature assembly in a position perpendicular and concentric to the valve seat sealing surface. More specifically, this requires good concentricity between the armature and needle guiding faces, good concentricity between the upper and lower guide faces, and sufficiently tight upper and lower guide clearances.

Failure to meet these concentricity requirements can cause many problems, including the needle tilting from the axis, the needle binding to the guides, the needle being bent by the guides, the needle wearing on the guiding faces, and in the worse scenario, a gap being formed in the circumferential sealing surface between the tip of the needle and the valve seat. Therefore, needle misalignment deteriorates the injector performance by increasing needle-guide friction, accelerating wear of needle and guides, and causing leakage. On the upper end of the armature-needle assembly, the needle misalignment results in uneven air gap between the two magnetic pole faces of the armature. This may cause non-uniform magnetic flux distribution, inconsistent stroke, and bad flow linearity.

It can therefore be seen that the formation of the upper and lower guides, as well as of the needle-armature assembly is of paramount importance. Typically, the upper and lower guides are small parts which are individually formed and attached to other structures forming the fuel injector valve. The separate guides usually have a complicated shape with a central guiding hole and several flow passing holes. This requires precision grinding on both the outer diameter and the inner diameter surfaces, as well as very tight tolerances to maintain the concentricity. Unfortunately, these guide pieces are usually hardened and are too small to be held appropriately for machining. Furthermore, the assembly and fastening method for these guides in the injector are complicated, and may introduce additional problems. All of the above also increases cost. Therefore, there exists a need to provide a fuel injector having lower and/or upper guides which improve overall performance by maintaining good concentricity between the guiding faces, the valve assembly and the valve seat, while providing simple and cost effective manufacture and assembly.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
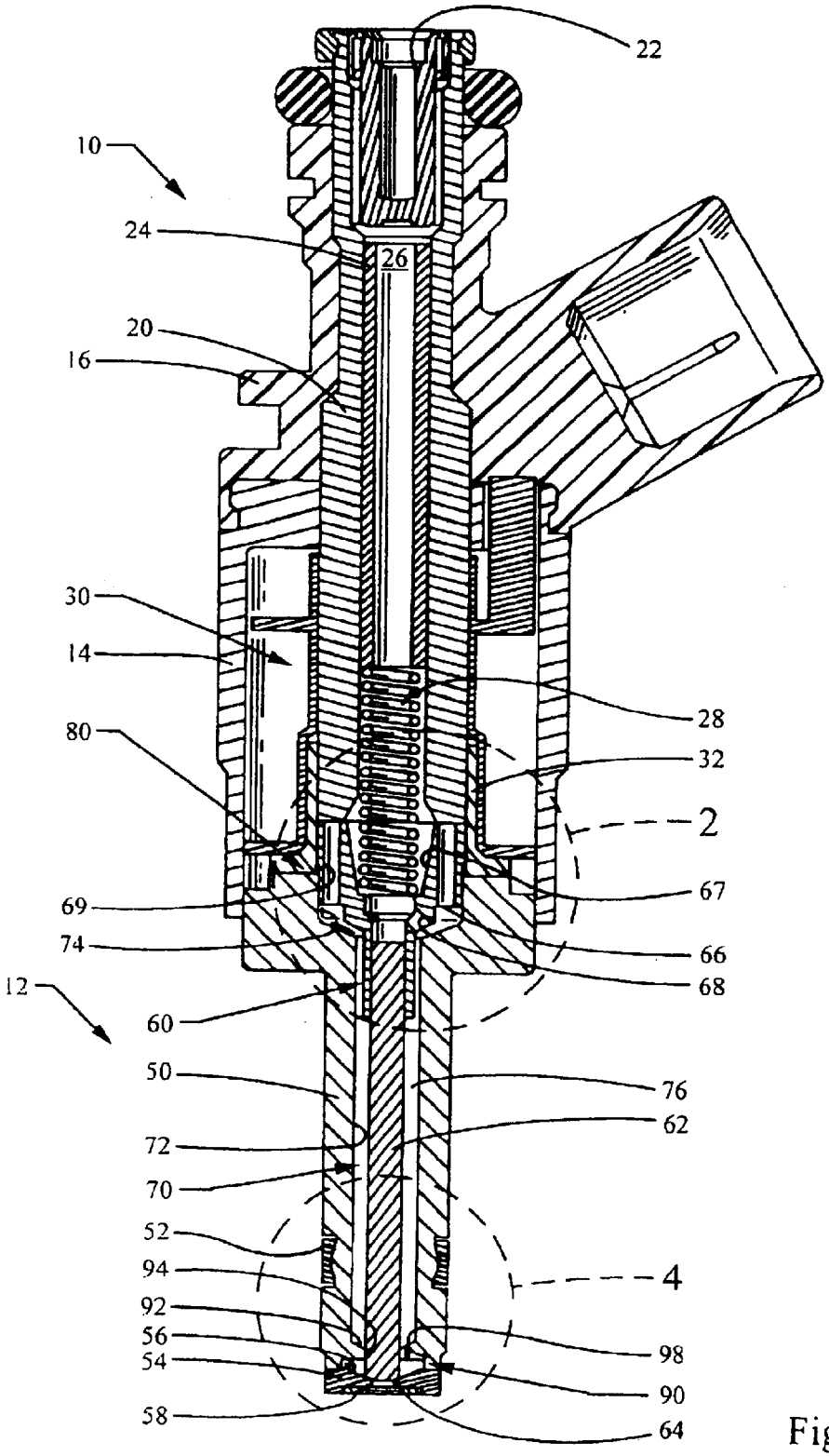
FIG. 1 is a cross-sectional view of an embodiment of the fuel injector constructed in accordance with the teachings of the present invention.

Turning now to the figures, FIG. 1 illustrates an embodiment of a fuel injector 10 constructed in accordance with the teachings of the present invention. The fuel injector 10 generally comprises a valve assembly 12 which is operable between open and closed positions to regulate the flow of fuel to an engine. An upper end of the valve assembly 12 is connected to a housing 14, which in turn is connected at its upper end to an overmold casing 16. Contained with the housing 14 and casing 16 is an inlet tube 20 which has a filter 22 disposed at its upper end for receiving a flow of fuel. An adjustment tube 24 is disposed within the inlet tube 20 and defines an inner chamber 26 through which fuel flows from the filter 22. A lower end of the adjustment tube 24 abuts against a spring 28 which biases the valve assembly 12 to its closed position. The housing 14 further encloses a coil assembly 30 which has leads extending through the housing 14 and the overmold casing 16 for electrical hook-up. As is known in the art, the coil assembly 30 is excited to operate the valve assembly 12 between the open and closed positions. A non-magnetic shell or sleeve 32 is interposed between the coil assembly 30 and the inner tube 20.

The valve assembly 12 generally comprises a valve body 50 enclosing a needle assembly 60. The upper end of the valve body 50 is attached to the housing 14 and the non-magnetic shell 32, preferably by an appropriate weld. A lower portion of the valve body 50 includes a seal ring 52 on its outer surface. A lower end of the valve body 50 includes a nozzle 54 defining a valve seat 56 and a valve port 57 (see FIG. 4). A metering plate 58 is attached to the nozzle 54 below the seat 56 and port 57 and includes a plurality of discharge holes for manipulating the flow of fuel to the engine.

The needle assembly 60 generally comprises a needle body 62 and an armature 66. The armature 66 includes a recessed portion 67 sized to receive the lower end of the spring 28. Thus, the recessed portion 67 is in fluid communication with the passage 26. The armature 66 generally includes a first set of flow holes 68 and a second set of flow holes 69. The first set of flow holes 68 are in communication with the recessed portion 67, while the second set 69 extend through the armature 66 from its upper surface to a lower surface. The second set of flow holes 69 are adapted to provide venting to prevent the armature 66 from being held upward adjacent the inner tube 20 by hydraulic sticking. Further, the presence of the holes 69 reduces the mass of the armature 66. An upper end of the needle body 62 is attached to the armature 66, preferably by laser welding or swaging. A lower end of the needle body 62 defines a needle tip 64 for sealingly engaging the valve seat 56.

The valve body 50 defines an inner bore 70 including a smaller lower bore portion 72 and a larger upper bore portion 74. The inner bore 70 receives the needle assembly 60. More specifically, the upper bore portion 74 receives the armature 66, while the lower bore portion 72 receives the needle body 62 and its connection to the armature 66. The outer diameter of the needle body 62 is smaller than the inner diameter of the lower bore portion 72, thus defining an annular flow passage 76 therebetween.

In operation, fuel passes through the filter 22 into the inlet passage 26, and then to the recessed portion 67 of the armature 66. Fuel then flows through the first passage defined by flow holes 68, and then into the second flow passage 76 defined between the needle body 62 and the valve body 50. Fuel thus flows down to the nozzle 54, and is regulated by the position of the needle tip 64 relative to the valve seat 56. The position of the needle body 62 and its tip 64 is regulated by the coil assembly 30. The solenoid or coil assembly 30 generates a magnetic flux that acts upon the armature 66 to move the needle assembly 60 into the open position against the spring 28. When the solenoid 30 is no longer energized, the force of the spring 28 moves the needle assembly 60 to close the valve 12 once again.

Figure 4:
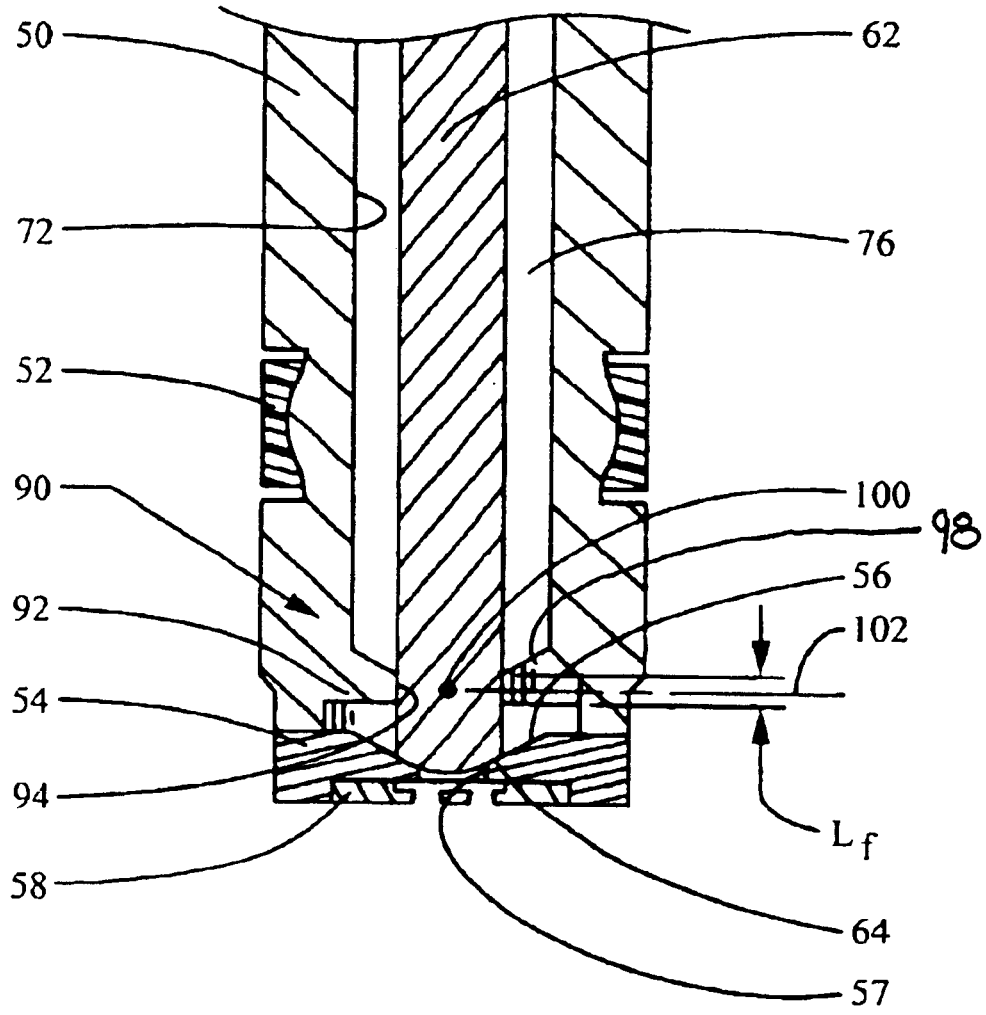
FIG. 4 is an enlarged, partially cut-away, view of the valve tip of the fuel injector shown in FIG. 1, taken about the circle denoted by numeral 4.

In order to achieve the need for concentricity while simplifying manufacture and assembly and reducing cost, the fuel injector 10 includes an upper guide 80 and a lower guide 90 that are integrally formed with the valve body 50. For example, the lower guide 90 is machined as a part of the injector valve body 50, as best seen in FIGS. 4 and 1. The lower guide 90 generally comprises a flange 92 projecting radially inwardly from the inner surface of the valve body 50 defined by the lower bore portion 72. An inner annular surface 94 of the flange 92 acts as a guide surface for engaging the outer surface of the needle body 62. The flange 92 includes a plurality of flow holes 98 defining a third passage for passing fuel to the seat 56.

Figure 2:
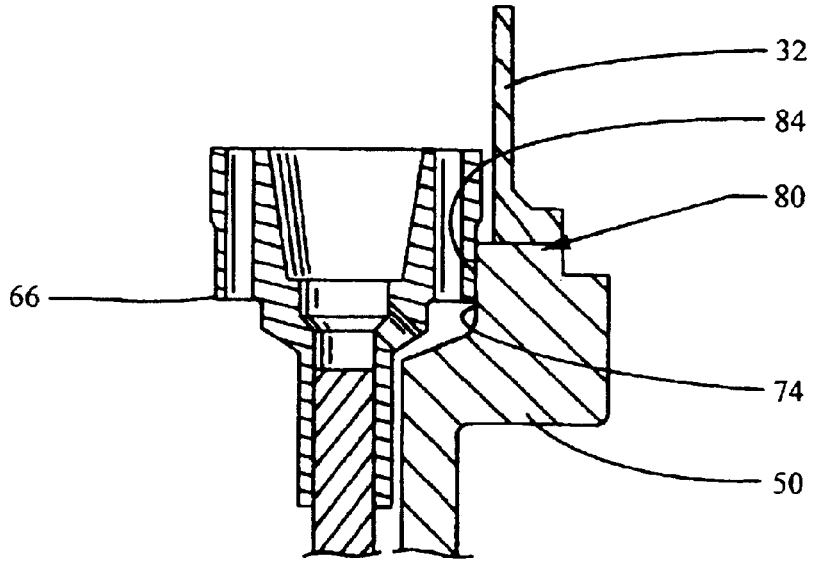
FIG. 2 is an enlarged, partially cut-away, of the armature and upper guide of the fuel injector shown in FIG. 1, taken about the circle denoted by numeral 2.

As best seen in FIG. 2, the upper guide 80 simply comprises the inner surface 84 of the upper bore portion 74 of the bore 70. In this situation, a radial air gap may be needed to reduce the magnetic sticking of the armature 66 to the valve body 50. For example, the armature outer surface can be chrome plated to create such a radial air gap. In this embodiment, the non-magnetic sleeve 32 is spaced from the outer surface of the armature 66, preferably about 100 microns. To ensure perfect concentricity between the upper and lower guides 80, 90, it is best to grind both of the inner diameter surfaces simultaneously, namely guide surface 94 of lower guide 90 and guide surface 84 of upper guide 80. Alternately, the inner diameter surfaces may be ground subsequently while holding the valve body 50 and utilizing the same datum face of the outer diameter of the valve body 50 held within a chuck.

Figure 3:
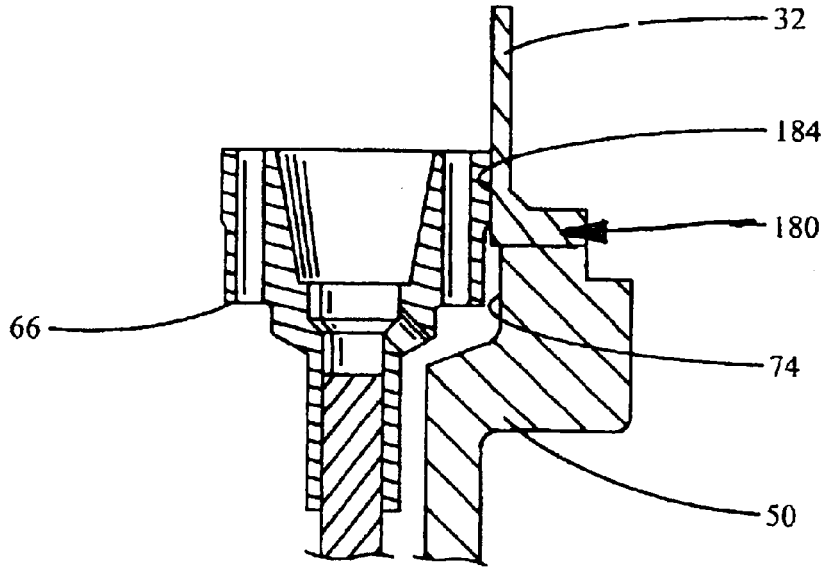
FIG. 3 is an enlarged, partially cut-away view similar to that of FIG. 2, but showing an alternate embodiment of the fuel injector constructed in accordance with the teachings of the present invention.

Another embodiment of the invention is depicted in FIG. 3. The embodiment is similar in all respects to the prior embodiment, except with regard to the upper guide 80. More specifically, the upper guide 180 of this embodiment is generally formed by the inner surface 184 of the non-magnetic sleeve 32. As in the prior embodiment, the upper bore portion 74 is ground in conjunction with the lower guide 90 and its guide surface 94 to ensure perfect concentricity therebetween. Accordingly, the non-magnetic shell 32 is aligned concentrically to the upper bore portion 74 of the valve body 50 by using an expanding guide pin or mandrel that guides the inner diameter of the shell 32 to the inner diameter of the upper bore portion 74. Thus, when the non-magnetic shell 32 is used as the upper guide 180, both guides 180 and 90 are still concentric. The upper bore portion 74 is spaced from the armature to create an air gap, preferably about 100 microns in size, to prevent sticking.

In the prior embodiment of the upper guide 80, it is also preferable to guide the non-magnetic sleeve 32 to the inner diameter of the upper bore portion 74 by using the expanding guide pin. In this way, the inlet tube will be guided concentrically to the armature 66 by the shell 32. This ensures a parallel air gap between the pole faces of the inlet tube 20 and the armature 66. Preferably, the sleeve 32 is laser welded to the upper end of the valve body 50.

Additional factors are also important to maintain good alignment in the fuel injector. In addition to the concentric upper and lower guides 80 (or 180), 90, the concentricity of the needle assembly 60, and more particularly the outer diameter of the armature 66 and the needle body 62 are important. Further, the concentricity of the valve seat 56 to both the upper and lower guides 80 (or 180), 90, as well as the roundness and surface finish of the needle tip 64 and the valve seat cone 56, are also important. Accordingly, the armature 66 and the needle body 62 are assembled together, preferably by either laser welding or swaging. Then, the needle tip 64 and the outer diameter of both the needle body 62 and the armature 66 are simultaneously ground to achieve perfect concentricity between the guiding faces of the needle assembly 60 and perpendicularity of the armature 66 and needle tip 64 to the central axis. If the two ends of the needle assembly 60 have to be processed separately, the common datum face on the outer diameter of the needle body 62 should be used to hold the part for both grinding operations.

As in any grinding process, it is inevitable to have tolerance and deviation in the above-mentioned process. Some level of minor misalignment should be expected and allowed. Therefore, to guarantee a seal at the valve seat 56 with such minor misalignment, the needle tip 64 of the present invention is formed into a spherical shape. More particularly, the needle tip 64 preferably has a semi-spherical shape. Additionally, the valve seat 56 is preferably conically shaped whereby the needle tip and seat form a seal about a circular line. Unlike a conical needle tip to a conical seat engagement, the spherical needle tip 64 can accommodate a certain level of misalignment and still seals on a circular sealing surface formed in conjunction with the valve seat 56. It will also be recognized that the seat 56 could be spherical, i.e., convex, while the needle tip 64 is conical. This would still provide a circular line seal as just described.

Furthermore, the present invention further increases the insensitivity of the needle misalignment, by ideally positioning the lower guide 90. More specifically, the pivot point of the spherical needle tip 64 is aligned with the lower guide 90. As best seen in FIG. 4, the center point of the spherical surface of the needle tip 64 forms the pivot point that has been denoted by numeral 100. The center point 100 is preferably coincided with the center of the lower guide surface 94. As shown in the figure, the guide surface 94 has an axial length $L_f$ which has a center denoted by line 102. This center line 102 is axially aligned with the pivot point 100. Therefore, even if the needle body 62 is slightly tilted from the center axis, the spherical surface of the needle tip 64 still completely seals on the conical seat 56 about a circular line; the needle body 62 being pivoted by the lower guide 90 about pivot point 100. When the needle tip 64 is conical and the seat 56 is convex, a pivot point can still be identified based on the center point of the spherical element, i.e. the spherical diameter of the seat and the diameter of the circular seal line. Thus, the guide 90 can be located to achieve the same benefits.

Accordingly, it can be seen that the present invention provides better concentricity between the two upper and lower guides by integrally forming them in the valve body 50. Furthermore, this invention also eliminates two small but expensive parts, the upper and lower guides. It eliminates the precision grinding on both of the inner and outer diameter surfaces of the guides, the tight tolerances, and the difficulty with machining. Furthermore, the methods of assembling and fastening these guides in the injector are eliminated. Therefore, the present invention provides a simple and cost effective method of forming upper and lower guides to improve the reliability of the seal on the injector valve, improving over all performance.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A fuel injector for an engine comprising:

a valve body having an inner bore defining an inner surface;

a valve seat positioned at a lower end of the valve body;

a needle assembly positioned within the inner bore of the valve body, the needle assembly including a needle body and an armature connected to an upper end of the needle body, a lower end of the needle body defining a needle tip for sealingly engaging the valve seat;

a pair of guides formed with the valve body as a single solid piece for guiding the needle assembly, the pair of guides including an upper guide and a lower guide, the upper guide guiding the armature, the lower guide guiding the needle body, the lower guide including a flange projecting inwardly relative to the inner surface; and the armature including a first flow passage, the needle body and the inner surface defining a second flow passage therebetween, and a third flow passage extending through the flange of the lower guide, the first, second and third flow passages in fluid communication for passing fuel to the valve seat.

2. The fuel injector of claim 1, wherein the needle body has a continuous annular outer surface.

3. The fuel injector of claim 1, wherein the needle body has a circular cross-section along the length of the needle body.

4. The fuel injector of claim 1, wherein the inner bore includes an upper bore portion and a lower bore portion, the upper bore portion having a larger diameter than the lower bore potion, the upper bore portion receiving the armature of the needle assembly.

5. The fuel injector of claim 4, wherein the upper bore portion forms the upper guide.

6. The fuel injector of claim 5, wherein the armature has an outer surface formed of a non-magnetic material.

7. The fuel injector of claim 1, wherein the needle tip is spherical.

8. The fuel injector of claim 7, wherein the centerpoint of the curvature of the spherical needle tip is radially aligned with the lower guide.

9. The fuel injector of claim 1, wherein the upper guide includes a non-magnetic sleeve.

10. The fuel injector of claim 9, wherein the non-magnetic sleeve of the upper guide engages the armature.

11. A fuel injector for an engine comprising:

a valve body having an inner bore defining an inner surface;

a valve seat positioned at a lower end of the valve body;

a needle assembly positioned within the inner bore of the valve body, the needle assembly including a needle body and an armature connected to an upper end of the needle body, the armature having an outer surface formed of a non-magnetic material, a lower end of the needle body defining a needle tip for sealingly engaging the valve seat;

the lower end of the valve body having a lower guide positioned above the valve seat and extending radially inwardly to define a guide surface, the inner bore of the valve body defining an upper guide for engaging the armature to guide an upper portion of the needle assembly; and the needle body having a continuous annular outer surface, the guide surface contacting the needle body's annular outer surface for concentrically guiding the needle tip to the valve seat.

12. The fuel injector of claim 11, wherein the lower guide includes a flow passage extending therethrough.

13. The fuel injector of claim 11, wherein the needle body has a circular cross-section along the length of the needle body.

14. The fuel injector of claim 11, wherein the needle tip is spherical.

15. The fuel injector of claim 14, wherein the centerpoint of the curvature of the spherical needle tip is radially aligned with the lower guide.

16. A fuel injector for an engine comprising:

a valve body defining an inner bore;

a valve seat positioned at a lower end of the valve body:

a needle assembly positioned within the inner bore of the valve body, the needle assembly including a needle body having a lower end defined by a continuous annular outer surface, the lower end defining a needle tip or sealingly engaging the valve seat, the needle body having a pivot point;

a lower guide associated with a lower end of tie valve body for guiding the needle body, the lower guide including a flange projecting radially inwardly to define a guide surface, the guide surface extending axially, the flange defining a flow passage therethrough; and the lower guide being radially aligned with the pivot point of the needle body.

17. The fuel injector of claim 16, wherein the needle tip has a semi-spherical shape.

18. The fuel injector of claim 17, wherein the pivot point is at the centerpoint of the curvature of the semi-spherical needle tip.

19. The fuel injector of claim 17, wherein the valve seat is conically shaped.

20. The fuel injector of claim 17, wherein the pivot point is located axially away from the semi-spherical tip a distance that is aligned with the continuous annular outer surface of the lower end.

21. The fuel injector of claim 16, wherein the axially extending guide surface has a center line that is aligned with the pivot point.

22. The fuel injector of claim 16, wherein one of the valve seat and the needle tip have a curved annular surface, and wherein the pivot point is located based on the diameter of the curvature of the curved annular surface.

* * * * *